United States Patent [19]

Honacker

[11] 3,998,611

[45] Dec. 21, 1976

[54] COLLECTOR ELECTRODES FOR ELECTROSTATIC PRECIPITATORS

[75] Inventor: Horst Honacker, Paradise Valley, Ariz.

[73] Assignee: Dart Industries, Los Angeles, Calif.

[22] Filed: May 22, 1975

[21] Appl. No.: 579,960

[52] U.S. Cl. ..... 55/118; 55/148; 55/154; 55/DIG. 38; 261/112

[51] Int. Cl.[2] ..... B03C 3/78

[58] Field of Search ..... 55/117–119, 55/122, 108, 140, 146, 148, 154, 155, 156, 241, DIG. 38; 261/112; 250/539, 540; 428/36, 313, 322, 426

[56] References Cited

UNITED STATES PATENTS

| | | | |
|---|---|---|---|
| 1,437,760 | 12/1922 | Kuhlenschmdt | 250/539 X |
| 1,984,690 | 12/1934 | Nahigyan | 55/241 X |
| 2,419,452 | 4/1947 | Ketchum | 261/112 |
| 3,238,702 | 3/1966 | DeSeversky | 55/119 |
| 3,385,575 | 5/1968 | Hall | 55/241 X |
| 3,716,966 | 2/1973 | DeSeversky | 55/148 X |
| 3,742,681 | 7/1973 | DeSeversky | 55/119 |
| 3,765,154 | 10/1973 | Hardt et al. | 55/155 X |
| 3,785,125 | 1/1974 | DeSeversky | 55/119 |
| 3,856,476 | 12/1974 | DeSeversky | 55/119 X |

FOREIGN PATENTS OR APPLICATIONS

| | | | |
|---|---|---|---|
| 119,973 | 10/1959 | U.S.S.R. | 250/539 |
| 450,439 | 7/1936 | United Kingdom | 55/241 X |
| 23,078 | 8/1908 | United Kingdom | 261/112 |

*Primary Examiner*—Frank W. Lutter
*Assistant Examiner*—David L. Lacey

[57] ABSTRACT

The disclosure relates to collector electrodes for electrostatic precipitators and particularly to generally annular in cross section hollow cylindrical collector electrodes having a pair of spaced concentric wall structures with a filler means disposed therebetween, the filler means being a lightweight filler means and hermetically sealed in and between said wall structures. The disclosure also relating to fixture means in the lower ends of the hollow cylindrical collector electrodes, the fixture means comprising internally screw threaded openings in blocks secured or fixed to the lower ends of the collector electrode so as to provide for the use of screw threaded bolts for securing the lower ends of the collector electrode structures in juxtaposition. The disclosure also relating to modifications and/or various species of the lightweight filler means between the inner and outer walls of the collector electrode.

Additionally, the disclosure relating to a novel water distributor means carried at the upper edge of the collector electrode for distributing water uniformly over the inner and outer walls of the collector electrode. The collector electrode being formed in a plurality of arcuate sections and secured to shoulder structure of the collector electrode body by means of screw threaded bolts.

The disclosure also relating to a method for producing collector electrodes for electrostatic precipitators.

19 Claims, 11 Drawing Figures

COLLECTOR ELECTRODES FOR ELECTROSTATIC PRECIPITATORS

PRIOR ART

U.S. Pat. Nos. 3,742,681 and 3,785,125 issued to Alexander P. de Seversky are examples of prior art considered to be most pertinent to the subject matter of this application.

BACKGROUND OF THE INVENTION

Various annular in cross section hollow cylindrical collector electrodes for electrostatic precipitators have been produced and operated with the well known wet wall principle wherein water flows downward on the surface of such electrodes and thereby serves as the electrostatic collector for foreign matter carried in air or gas streams passing in substantially laminar flow relationship to the surfaces of such electrodes. In some instances, each of such electrodes comprises inner and outer concentric annular walls between which water is conducted upwardly to spill over the upper edge thereof and to flow downward on inner and outer sides thereof. Such structures have been proved to be expensive to produce and maintain and have, therefore, caused considerable financial and functional problems relative to the prior art wet wall electrostatic precipitators.

Additionally, the prior art structural support of such collector elctrodes in combination with the means by which water conduits deliver water to the walls thereof have heretofore been complicated in terms of structural arrangement as well as maintenance and have, therefore, been quite costly overall. Those prior art collector electrode structures having water conduits extending upwardly therethrough or those which have water channels therein tend to cause arcing through the side walls of the electrodes and into the most conductive areas. In this manner some of the prior art collector electrodes deteriorated such as to cause very difficult maintenance problems. Additionally, some of the collector electrodes having water conduits extending upward therethrough were such that the structural integrity of the electrode was compromised to the extent that accurate spacing thereof could not be maintained to a desirable degree and, in many instances, those collector electrodes which had water conductors therein experienced or developed leaks which could not be fixed without disassembling a substantial percentage of the entire precipitator structure.

SUMMARY OF THE INVENTION

The present invention relates to a novel hollow cylindrical circular in cross section collector electrode structure for electrostatic precipitators wherein inner and outer annular walls are spaced apart and interconnected by lightweight filler structure which is totally encapsulated between the wall structures and end portions whereby a very lightweight hermetically sealed and arcuately accurate hollow cylindrical collector electrode structure is provided which has great rigidity for its weight and consequently maintains the spacing of the concentric inner and outer cylindrical collector electrodes. The collector electrode structure of the invention also comprises novel fixture means fixed in lower ends of the hollow cylindrical bodies of these electrodes so that they may be held in juxtaposition concentrically spaced relative to each other and in juxtaposition relative to a base and discharge electrodes which may be mounted adjacent thereto. Further the invention comprises a novel upwardly converging shoulder structure which extends upwardly in continuity from the inner and outer sides of the electrodes to a median portion which supports a tubular water delivery conduit having a series of openings on each side of the median portion which delivers water onto the sloping shoulders which are upwardly converging and conversely downwardly diverging to the surfaces of the collector walls. The series of water delivery openings at each side of the median area serving to wet the respective shoulder and wall structure and the individual openings being disposed at an angle such as to be directed generally downwardly and tangentially relative to walls of the hollow cylindrical elctrodes so as to provide for a uniform wet wall film thereon. The outer surfaces of the collector walls being textured so as to provide even distribution of water flow on the walls and to prevent surface tension from separating the flow as it passes from the upper portions of the walls downwardly to the lower portions thereof.

The invention also comprises novel means for securing the water distributor conduit on the top of the shoulder structure of the respective collector electrode and, in addition, the water conduit means may be made in several arcuate sections and bolted onto the upwardly converging shoulder structure of the collector electrode. The water inlet tubes communicating with the interior of the water distributor conduits deliver water onto an internal baffle which is between the water inlet tubes and the water distributor openings which distribute water downwardly and tangentially relative to the annular wall surfaces of the collector electrode structure.

Additionally, the invention relates to a method for producing collector electrodes for wet wall electrostatic precipitators wherein an arcuate form is used upon which resin and fibrous material may be laid up so that an accordian like cellular structure may be placed in arcuate conformity with the first resin and fiber layer and whereupon a second resin and fiber layer may be placed over the accordian like cellular structure to provide a pair of concentric wall structures which are spaced apart by the accordian like cellular wall structure which is in effect a lightweight filler structure bonded by the resin so that lightweight and arcuate integrity of the structure is provided by the method of the invention and whereby two semi-circular cylinder parts are formed in this manner and bonded together to form an annular in cross section hollow cylindrical electrostatic collector electrode body. The invention also comprising the formation of a pair of concentric hollow tubular members between which a bonding resin foam structure is first introduced in uncured condition and which during curing bonds to the hollow cylindrical members and forms a lightweight filler and also provides for a connection integrity between the inner and outer annular walls of the hollow tubular collector electrode body.

Accordingly, it is an object of the present invention to provide a collector electrode for electrostatic precipitators which comprises a pair of concentric hollow cylindrical walls spaced from each other and connected together by a lightweight filler and wherein the filler is hermetically sealed and encapsulated thereby forming a very rigid lightweight structure having concentric integrity and resistence to deterioration either by way of moisture or electrical discharge erosion.

Another object of the invention is to provide a novel lightweight collector electrode for electrostatic precipitators having a novel upwardly converging shoulder structure which mounts a novel water distributor conduit thereon.

Another object of the invention is to provide a novel upwardly converging shoulder structure which provides continuity from inner and outer walls of the hollow cylindrical body of the electrode structure and converges upwardly such that the conduit structure of the water delivery means may emit water through a series of openings on the downwardly diverging structure of the shoulder means and in a swirling relationship thereto such as to move in a generally helical path so as to provide uniform wetting of the shoulder structure and consequent uniform wetting of the relatively vertical annular inner and outer surfaces of the collector electrode.

Additionally, it is an object of the present invention to provide a novel surface finish on the inner and outer walls of the collector electrodes so as to provide for uniform wetting of these walls and to prevent surface tension from breaking the film of water as it travels downwardly on these surfaces.

Another object of the invention is to provide a matte finish for the water conducting surfaces of the collector electrode of the invention wherein these surfaces are abraided by sandpaper or similar materials having a range of grit size ranging from 150 to 400 mesh.

Anoher object of the invention is to provide a novel method for producing lightweight and very rigid hollow cylindrical collector electrodes for electrostatic precipitators.

Another object of the invention is to provide various means for forming a lightweight interconnecting filler structure between two inner and outer spaced apart annular walls concentric with each other whereby the filler structure bonds and holds the walls rigidly connected together.

Further objects and advantages of the invention may be apparent from the following specification, appended claims and accompanying drawings.

DESCRIPTION OF THE PREFERRED EMBODIMENTS

Figure 1:
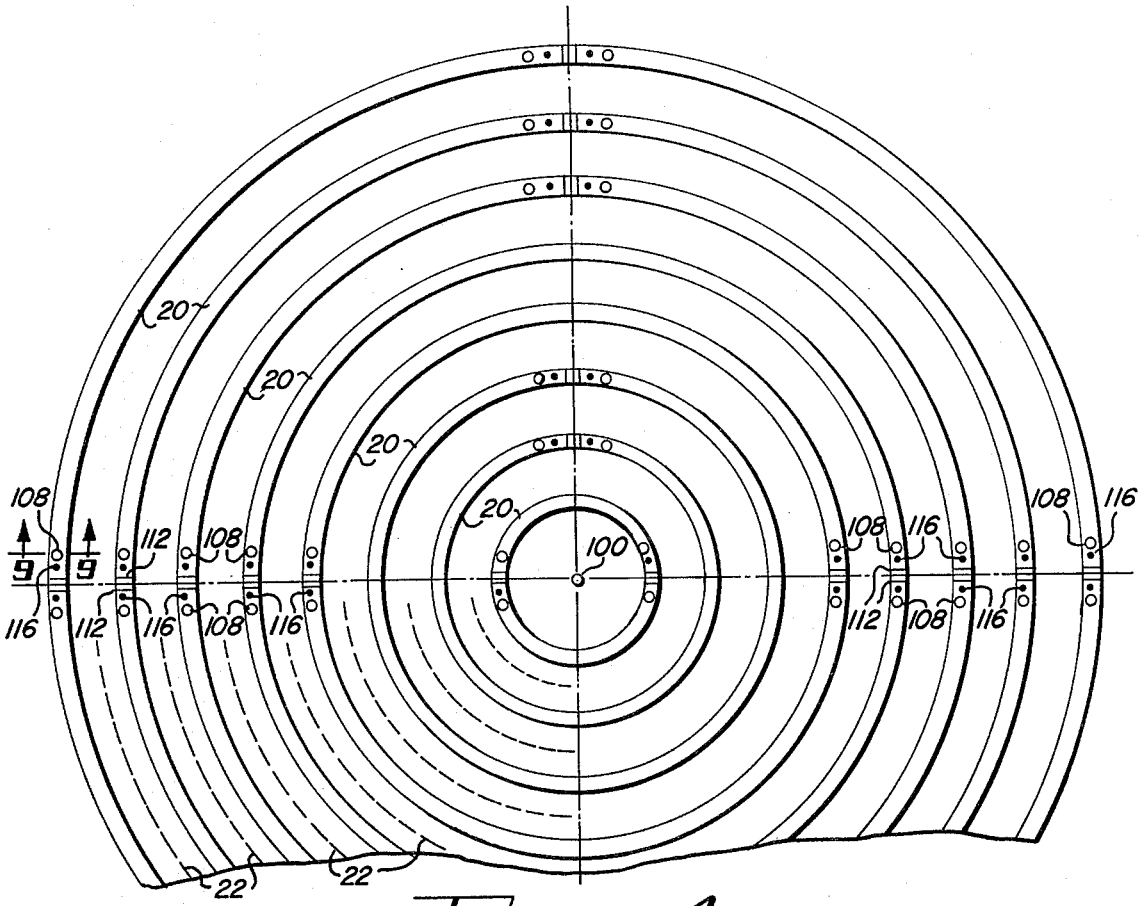
FIG. 1 is a fragmentary top or plan view of a plurality of collector electrodes for electrostatic filters produced in accordance with the present invention.
Figure 9:
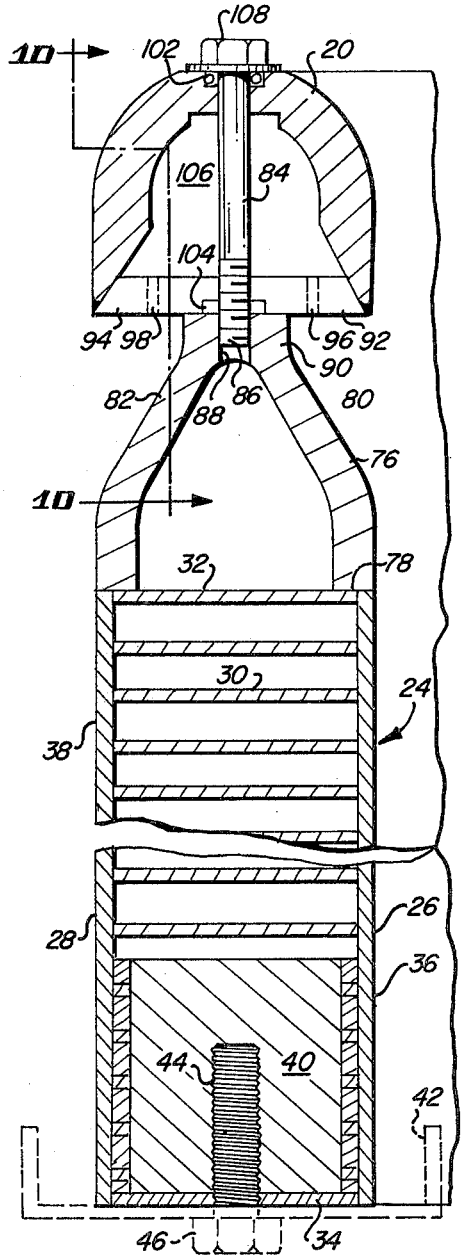
FIG. 9 is an enlarged fragmentary sectional view taken from the line 9—9 of FIG. 1.

As shown in FIG. 1 of the drawings, a plurality of collector electrodes are in assembly with discharge electrodes shown by broken lines. Each of the collector electrodes is substantially as shown in FIG. 9 of the drawings and each collector electrode is provided with a water distributor conduit 20 mounted thereon. All of the collector electrodes are disposed in concentric relationship with each other and are equally spaced apart so as to cooperate with discharge electrodes 22 as shown by broken lines and which are no part of the present invention.

As shown in FIG. 9 of the drawings, each collector electrode is provided with a hollow cylindrical body 24 having an inner concave annular wall structure 26 and an outer convex annular wall structure 28 with filler material 30 disposed between the spaced apart wall structures 26 and 28 and bonded thereto so as to provide rigid structural interconnection between the inner wall structure 26 and the outer wall structure 28. Each collector electrode body 24 is provided with an upper annular edge portion 32 and a lower annular edge portion 34 which are bonded to the upper and lower portions of the wall structures 26 and 28 so as to hermetically seal and encapsulate the filler material 30. This filler material 30 is a lightweight material and the wall structures 26 and 28 together with the upper edge portion 32 and lower edge portion 34 are preferably resin bonded fibrous material such as fiberglass bonded with epoxy resin or the like. The inner wall structure 26 is provided with an arcuate concave surface 36 while the outer wall structure 28 is provided with an arcuate convex surface 38. These surfaces 36 and 38 are adapted to receive a film of water thereon serving as a collector electrode structure and the water is distributed on these surfaces 36 and 38 as will be hereinafter described in detail.

Mounted into each body 24 between the respective inner and outer wall structures 26 and 28 are blocks 40 which are connection fixtures adapted to provide for holding the body 24 in juxtaposition relative to a base trough structure as indicated by broken lines 42 in FIG. 9 of the drawings.

Each block 40 is provided with an internally screw threaded opening 44 into which a cap screw 46 may be internally screw threaded all as indicated in FIG. 9 of the drawings.

Figure 2:
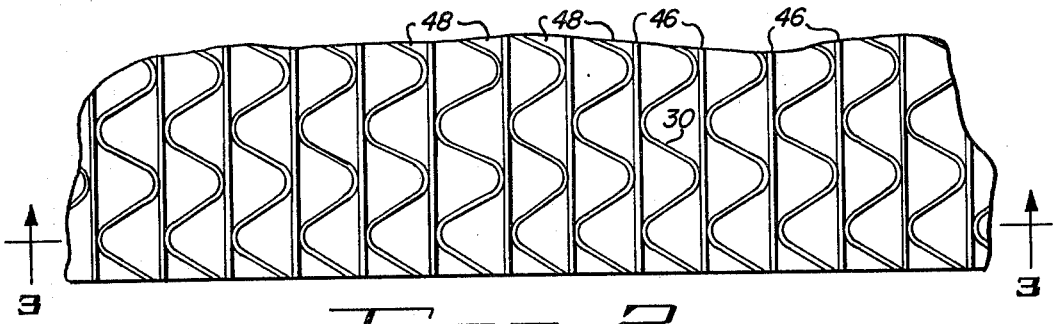
FIG. 2 is an enlarged sectional view of a formable cellular filler material used for producing collector electrodes of the present invention.
Figure 3:
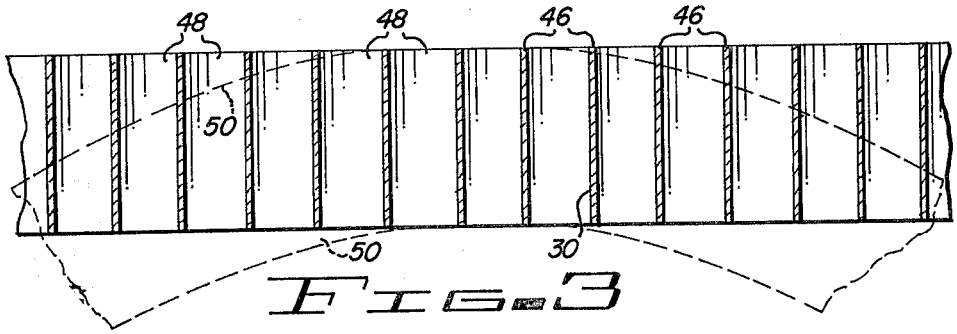
FIG. 3 is a view taken from the line 3—3 of FIG. 2 showing by broken lines a deflection characteristic of the structure shown in FIG. 2.

The filler material 30 is substantially a shown in FIGS. 2 and 3 of the drawings which comprises a series of flexible paper strips 46 disposed in generally parallel relationship to each other while intermediate corrugated strips 48 are bonded between the straight strips 46 to provide a cellular accordian like structure which may be readily deflected into an arcuate shape as indicated by broken line 50 in FIG. 3 of the drawings.

Figure 4:
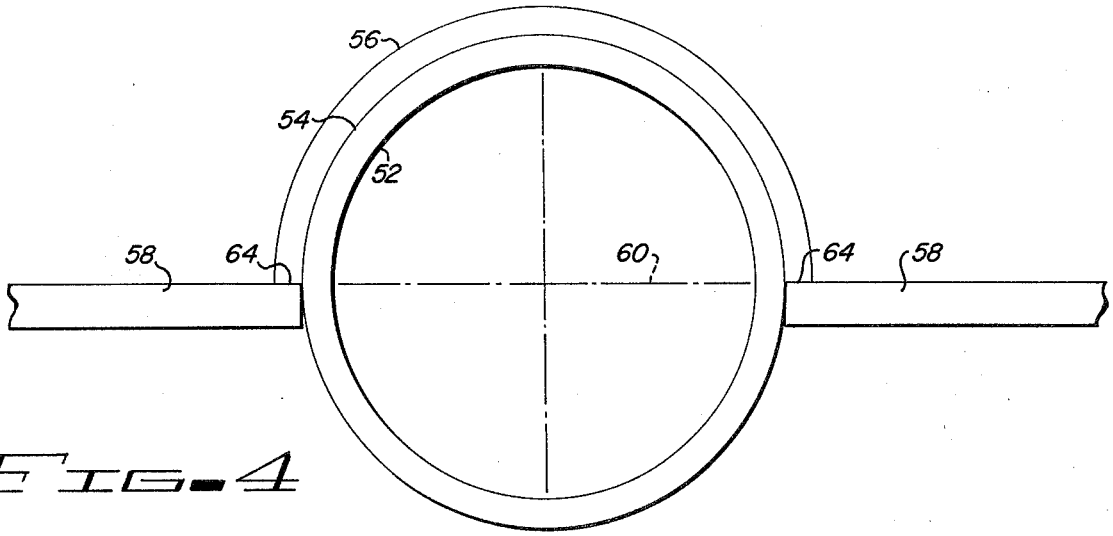
FIG. 4 is a diagramatic view of a form means on which semi-circular portions of generally hollow cylindrical collector electrode structures are formed by using the filler material shown in FIGS. 2 and 3 of the drawings.

Referring to FIG. 4 of the drawings, it will be seen that a mold structure 52 is provided with an external convex surface 54 adjacent to which a semi-circular cylindrical section 56 of the collector electrode 24 may be formed.

The table top structure 58 abuts the convex surface 54 of the mold structure 52 approximately on a center line 60 so that the semi-circular section 56 will be almost precisely 180° of the hollow cylindrical annular in cross section collector electrode body 24.

Figure 6:
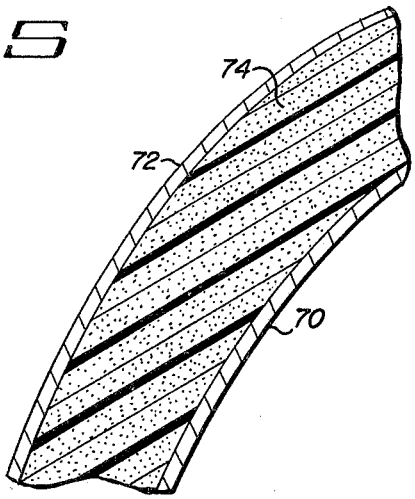
FIG. 6 is an enlarged fragmentary sectional view of a portion of a collector electrode wall structure of the invention illustrating resin bonded to inner and outer annular wall portions of the electrode body.
Figure 7:
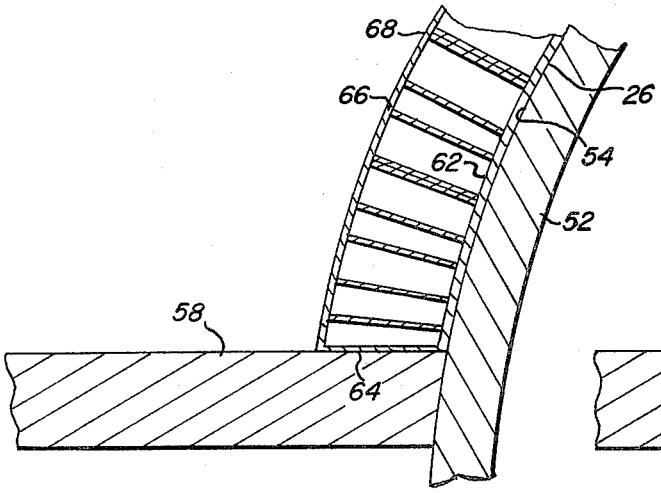
FIG. 7 is an enlarged fragmentary sectional view showing in detail the structure of the form shown in FIG. 4 and of an electrode structure being produced on the form and encapsulating filler material such as shown in FIGS. 2 and 3 of the drawings.
Figure 8:
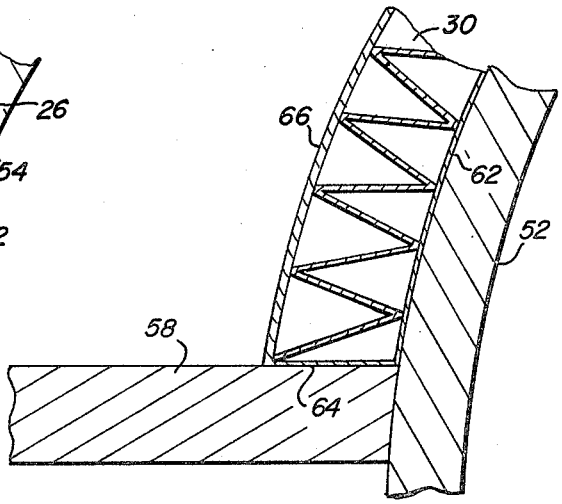
FIG. 8 is another view similar to FIG. 7 showing a modification of the filler material of the electrode structure body.

In the forming of each section 56, a method of the invention is practiced in accordance with the disclosure of FIGS. 6, 7 and 8.

Referring particularly to FIG. 7, it will be seen that the mold 52 and table 58 are maintained in juxtaposition with each other and the mold surface 54 is first coated with a substantially conventional release agent and then a resin gel coat 62 is applied to the mold surface 54 over the release agent and fiberglass cloth or mat may be then applied to form a portion of the inner structure 26. The acccordian like cellular material 30 is bent into arcuate conformity with the fiber and resin layer 62 and is resin bonded to the layer 62 as it is formed arcuately into intimate contact therewith. The accordian like cellular filler material 30 is preferably made of paper, metal, such as stainless steel, plastic or the like as shown in FIGS. 2 and 3 of the drawings and is easily deflectable into the arcuate configuration as indicated at 50 in FIG. 3. Thus, the filler material 30 is placed in arcuate conformity with the layer of fiberglass and resin designated 62 in FIG. 7 of the drawings.

It will be seen that the layer of fiberglass and resin 62 is provided with an integral portion 64 which extends horizontally on the table portion 58 and is thus disposed to form a bonding joint as will hereinafter be described in detail.

After the filler material 30 has been laid on the layer 62 in arcuate conformity therewith, a second layer 66 composed of fiberglass and resin is laid on the filler material 30 and bonded thereto so as to form a portion 68 of the outer wall structure 28 of the body 24. Thus the layers 62 and 66 ultimately become the wall structures 26 and 28 after a pair of the semi-circular parts, as shown at 56 in FIG. 4, have been bonded together at the portions 64 of the semi-circular parts 56 as shown in FIG. 4 of the drawings.

Figure 5:
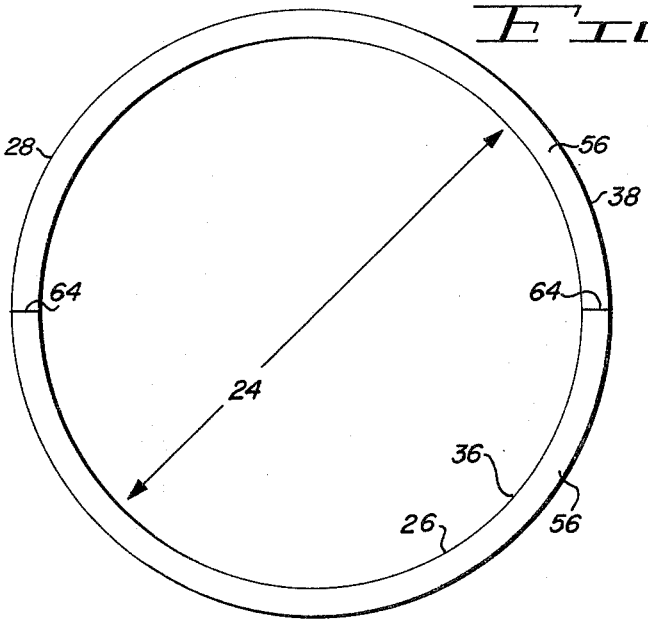
FIG. 5 is a view showing a pair of semi-circular electrode parts bonded together to form an annular in cross section collector electrode structure.

The bonding of these parts 56 is shown in FIG. 5 wherein each part comprises 180° of a full annular in cross section hollow cylindrical body member such as the body member 24 shown in FIG. 9. Thus the inner wall structure 26 and respective outer wall structure 28 are provided with respective concave and convex surfaces 36 and 38 respectively as hereinbefore described in connection with FIG. 9 of the drawings.

FIG. 8 illustrates a modification of the filler material 30 which is a different configuration of cellular accordian like structure which may be either of paper material or various other materials such as plastic or the like.

In the modification as shown in FIG. 6, circular in cross section wall structures 70 and 72 are first formed so as to be placed in concentric relationship with each other and supported in juxtaposition while a foam structure designated 74 is cured therebetween. This foam structure may be the conventional polyurethane foam structure which bonds to the adjacent surfaces of the wall structures 70 and 72. These wall structures 70 and 72 may be either a fiberglass resin combination or may be thin stainless steel hollow cylindrical parts to which the polyurethane foam structure bonds and provides an interconnection therewith. The upper and lower edge portions 32 and 34 may also be made of stainless steel. Accordingly, it will be appreciated that the filler material 30 and 74 is lightweight material which secures inner and outer wall structures together and the convex surface 38 of the body 24 and the concave surface 36 of the body 24 are abraided preferably by material such as wet or dry sandpaper or sand blasting and/or wire brushing and the abrasions may be formed at random by such sandpaper or sand blasting when the sand blasting grit or sandpaper grit ranges in grit size from 150 to 400 mesh size. These random abrasions provide for uniform wetting of the collector electrode wall surfaces simply because the random abrasions prevent surface tension separation of water flowing downwardly on these inner and outer collector electrode surfaces 36 and 38. The same textured surfaces are provided in connection with all of the structures as produced in accordance with the method illustrated and described in connection with FIGS. 6, 7 and 8.

Previous to the finishing of the surfaces by the foregoing abrasion process, a shoulder structure 76 is bonded at 78 to the upper edge structure 32 of each body 24. The bonding may be accomplished by means of epoxy resin or any other compatible resin, as for example, that which may be used in the fabrication of the body 24 hereinbefore described.

The shoulder structure 76 is provided with upwardly converging portions 80 and 82 which extend in continuity respectively from the inner concave surface 36 and the outer convex surface 38. This shoulder structure 76 may be of resinous material or suitable plastic which may be epoxy bonded and hermetically sealed to the upper edge structure 32 of the collector electrode body 24.

The upwardly converging surfaces 80 and 82 of the shoulder structure 76 are conversely downwardly diverging surfaces on which water flows into continuity with the concave and convex surfaces 36 and 38 hereinbefore described.

As shown in FIG. 9, water conduit structure 20 is secured to the shoulder structure 76 by means of bolts 84 which are provided with externally screw threaded portions 86 conformingly engaged with internally screw threaded openings 88 in an upper median portion 90 of the shoulder structure 76. As shown in FIG. 9, the median portion 90 is substantially narrower than the lower portion of the shoulder structure 76 which is equal to the thickness of the body 24 from the concave surface 36 to the convex surface 38.

The median portion 90 is relatively narrow and the water distributor conduit 20 is provided with overhanging bottom portions 92 and 94 which extend laterally beyond the median portion 90. The bottom portions 92 and 94 each being provided with a series of openings adapted to deliver water onto the upwardly converging or downwardly diverging shoulder portions 80 and 82. Openings 96 in the bottom portion 92 deliver water onto the downwardly diverging surface 80 of the shoulder portion 76 while openings 98 in the bottom portion 94 deliver water downwardly onto the downwardly sloping or diverging shoulder portion 82 of the shoulder structure 76.

Figure 10:
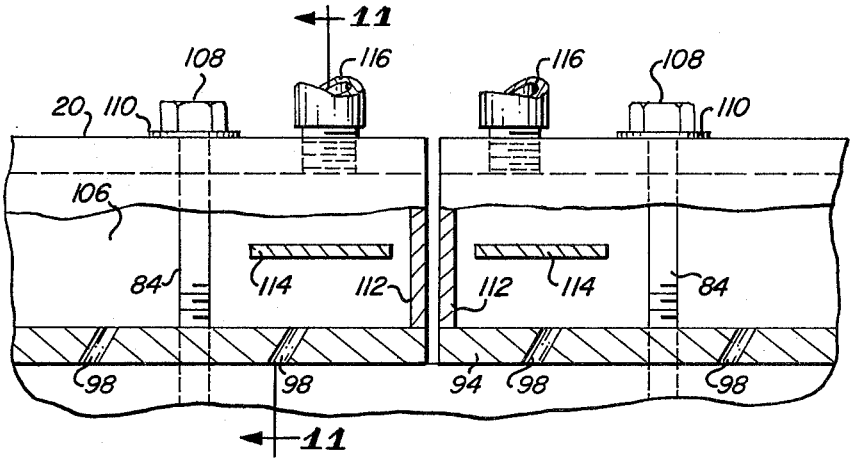
FIG. 10 is a fragmentary sectional view taken from the line 10—10 of FIG. 9.
Figure 11:
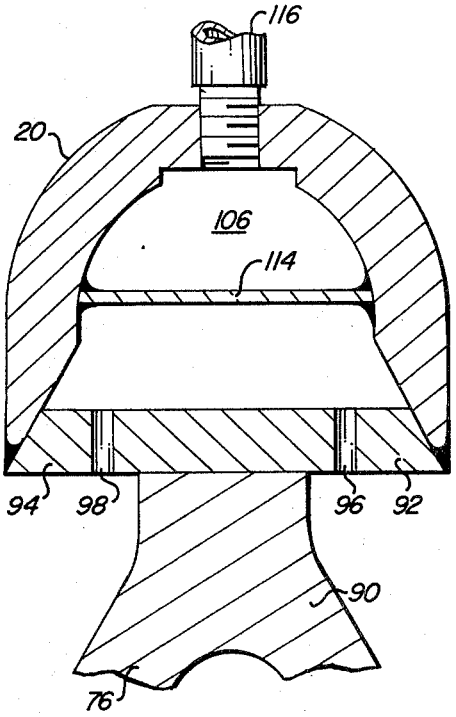
FIG. 11 is an enlarged fragmentary sectional view taken from the line 11—11 of FIG. 10.

As shown in FIG. 10, the openings 98 are disposed at a generally helical angle relative to the longitudinal or central axis of the body 24, said axis being indicated at 100 in FIG. 1 of the drawings, and being substantially parallel to the concave and convex surfaces 36 and 38 shown in FIG. 9 of the drawings.

Thus the aforementioned helical angle of the openings 98 is commonly known as a swirl angle and is adapted to cause the flow of water onto the shoulder portions 80 and 82 such that the water tends laterally to traverse the shoulder portions 80 and 82 and the respective concave and convex surfaces 36 and 38 of the hollow cylindrical circular in cross section body 24.

The hereinbefore described textured surfaces of the concave and convex surfaces 36 and 38 tend to prevent surface tension from causing flow separation thereon and the helical angle of the openings 98 provide for the distribution of water such that it spreads out on the downwardly diverging shoulder portions 80 and 82 in a manner such that the streams from the water delivery openings 98 overlap in a lateral direction to provide for a complete continuity of water film over the entire concave and convex surfaces 36 and 38 of the collector electrode body 24.

The conduit 20 as shown in FIG. 9 and also on various body members in FIG. 1 of the drawings may be made of several sections which are arcuate and these sections as shown in FIGS. 9 and 10 are held down by the bolts 84 and gasket structures 102 and 104, as shown in FIG. 9, prevent leakage of the water around the bolt 84 in the areas through which the bolt 84 passes and thus prevent the leakage of water from the interior 106 of the water distributor conduit 20.

It will be understood that the water delivery openings 96 and 98 are substantially identical and, therefore, the description of these water distributor openings, as shown in FIG. 10, applies to both sets or rows of water delivery openings. The water delivery conduit structure 20, as shown in FIG. 1 of the drawings, comprises substantially 360° even though several sections of an arcuate configuration are required to complete the 360° configuration shown in FIG. 1 of the drawings. Each bolt 84 is provided with a head 108 bearing on a washer 110 on the top of the respective section of the conduit 20. These conduits being provided with enclosed ends 112 adjacent to which baffles 114 are disposed to diffuse the flow of water from inlet tubes 116 which conduct water into the respective sections of the conduit means 20.

It will be understood that each collector electrode body 24 is provided with external wall and edge structures hermetically sealing and encapsulating a lightweight filler structure thereby providing a very rigid accurate hollow cylindrical and circular in cross section structure which is relatively light in weight and easy to handle and which may remain concentrically accurate relative to dicharge electrodes such as those indicated by broken lines 22 in FIG. 1 of the drawings but which are no part of the present invention.

It will be obvious that various lightweight filler materials may be used between the internal and external wall structures 26 and 28 for bonding them together. Such filler materials may be cellular or accordian like paper, metal or resin structures or may be resin foamed in place such as polyurethane resin or any other suitable material which provides a substantial interconnection between the walls and is also a lightweight material.

It will be appreciated that the filler material is entirely hermetically sealed and encapsulated in the wall structure and upper and lower edge structure so that moisture is unable to enter the interior of the body structure 24 and such that only the inner and outer concave and convex surfaces 36 and 38 are subject to the flow of water to act as collector electrode surfaces.

It will be obvious that various methods may be used to produce the collector electrodes of the present invention, as for example, the method described in connection with FIGS. 4, 5, 7 and 8 and also the method described in connection with the description of FIG. 6.

It will be obvious to those skilled in the art that various modifications may be resorted to without departing from the spirit of the invention.

I claim:

1. A collector electrode for electrostatic precipitators; a hollow cylindrical body having upper and lower open ends; said body having substantially annular upper and lower edge portions; said collector electrode having a substantially vertical axis concentric with said annular edge portions; said body having an inner concave annular wall and an outer convex annular wall; said inner and outer walls being spaced apart; lightweight filler means between said walls; said filler means structurally connecting said walls together; said inner and outer walls and said upper and lower edge portions bonded together and encapsulating said lightweight filler means.

2. The invention as defined in claim 1, wherein: fixture means is disposed and fixed in said lower end of said collector electrode; said fixture means located between said inner and outer walls and adjacent said lower edge portion.

3. The invention as defined in claim 2, wherein: said fixture means comprises blocks of material having internally screw threaded openings therein; said lower edge portion having openings exposing said internally screw threaded openings; said internally screw threaded openings adapted to receive externally screw threaded bolts for holding said body in juxtaposition.

4. The invention as defined in claim 1, wherein: said inner and outer walls are provided with textured surfaces including random direction abrasions such as may be equal to abrasions formed by 150 to 400 mesh grit sandpaper.

5. The invention as defined in claim 1, wherein: a generally tubular water conduit structure is disposed above said body; a shoulder structure connected to said upper edge portion of said body, said shoulder structure having upwardly converging portions which form a median portion; said tubular water conduit structure is connected to said median portions; said conduit structure having a series of downwardly directed water outlet openings disposed on each side of said median portion; each of said series of said water outlet openings disposed to deliver water downwardly onto one of said upwardly converging portions.

6. The invention as defined in claim 5, wherein: said water outlet openings are disposed at an angle such as to be directed generally downwardly and tangentially relative to said inner and outer walls.

7. The invention as defined in claim 5, wherein: said conduit structure is removably secured to said shoulder structural bolts extending downwardly through said conduit structure and screw threaded into said shoulder structure; and gasket means around said bolts to prevent leakage of water therearound and from the interior of said conduit structure.

8. The invention as defined in claim 7, wherein: water inlet means communicates with the interior of said water conduit.

9. The invention as defined in claim 8, wherein: baffle means is disposed in said conduit between said water inlet means and said water outlet openings.

10. The invention as defined in claim 5, wherein: said water distributor comprises a plurality of arcuate sections arranged in a generally annular assembly.

11. The invention as defined in claim 10, wherein: said water outlet openings being disposed at an angle such as to be directed generally downwardly and tangentially relative to said inner and outer walls; said arcuate sections of said conduit being removably secured to said shoulder structure; bolts extending downwardly through said arcuate sections and screw threaded into said shoulder structure; and gasket means surrounding said bolts to prevent leakage of water therearound and from the interior of said conduit.

12. The invention as defined in claim 1, wherein: said lightweight filler means being a cellular structure.

13. The invention as defined in claim 12, wherein: said cellular structure being a generally resilient means and being generally accordian like.

14. The invention as defined in claim 1, wherein: said lightweight filler means being a resin foam structure.

15. The invention as defined in claim 1, wherein: said inner and outer walls and said edge portions being of resin bonded fibrous material.

16. The invention as defined in claim 1, wherein: said inner and outer walls and said edge portions being of stainless steel.

17. The invention as defined in claim 1, wherein: said hollow cylindrical body comprises a pair of substantially semi-circular in cross section portions bonded together.

18. The invention as defined in claim 1, wherein: said inner and outer walls and said upper and lower edge portions being hermetically sealed together to prevent entrance of water into said filler means.

19. The invention as defined in claim 1, wherein: said walls and said upper and lower edge portions are made of metal; and said lightweight filler means is made of metal.

* * * * *